US005712238A

United States Patent [19]

Chan

[11] Patent Number: 5,712,238

[45] Date of Patent: Jan. 27, 1998

[54] MULTIPURPOSE CLEANING AGENT

[76] Inventor: Wu Hsiung Chan, 4F., No. 530 Sung Chiang Rd.,, Taipei, Taiwan

[21] Appl. No.: 691,707

[22] Filed: Aug. 2, 1996

[51] Int. Cl.[6] ..... C11D 3/065; C11D 1/37; C11D 9/12; C11D 9/14

[52] U.S. Cl. ..... 510/367; 510/111; 510/114; 510/119; 510/125; 510/126; 510/127; 510/130; 510/156; 510/276; 510/290; 510/300; 510/302; 510/305; 510/306; 510/310; 510/318; 510/320; 510/352; 510/357; 510/361; 510/392; 510/414; 510/425; 510/428; 510/431; 510/434; 510/436

[58] Field of Search ..... 510/111, 114, 510/119, 125, 126, 127, 130, 156, 276, 290, 300, 302, 305, 306, 310, 318, 320, 352, 357, 361, 367, 392, 414, 425, 428, 431, 434, 436

[56] References Cited

U.S. PATENT DOCUMENTS 5,338,491 8/1994 Connor et al. ..... 252/548

*Primary Examiner*—Paul Lieberman
*Assistant Examiner*—Charles Boyer
*Attorney, Agent, or Firm*—Bacon & Thomas

[57] ABSTRACT

A multipurpose cleaning agent containing 6.5–8% sodium alkyl sulfate, 2.7–4% fatty acid coconut diethanolamide, 0.38–0.42% citric acid, 0.38–0.42% ethylene diamine tetraacetic acid, 0.42–0.48% sodium citrate, 2.88–3.2% water, 1.88–2.5% sodium polyoxyethylene alkyl ether sulfate, 0.5–1% sodium carboxy methyl cellulose, 0.2–0.4% sodium percarbonate, 2–5% sodium tripoly phosphate, 40.38–35.89% low density sodium carbonate, 40.38–35.89% $Na_2SO_4.H_2O$, 0.4–0.8%, savinase 40T, and 1–2% celluzyme 0.7T.

1 Claim, No Drawings

MULTIPURPOSE CLEANING AGENT

BACKGROUND OF THE INVENTION

The present invention relates to cleaning agent, and relates more particularly to a multipurpose cleaning agent made from sodium alkyl sulfate, fatty acid coconut diethanolamide, citric acid, ethylene diamine tetraacetic acid, citric acid soda, water, sodium polyoxyethylene alkyl ether sulfate, sodium carboxy methyl cellulose, sodium percarbonate, sodium tripoly phosphate, soda ash light, mirabilite, savinase 40T, and celluzyme 0.7T.

A variety of cleaning agents and detergents are commercially available for different cleaning purposes. For cleaning different thinks, different cleaning agents and detergents shall be used. Therefore, every family spends a lot of money in purchasing different cleaning agents and detergents for different cleaning purposes. When a variety of cleaning agents and detergents are prepared, much storage space is required. Regular detergents or concentrated detergents commonly made from ABS (tetra propylene benzene sulfonic acid salt) or LAS (linear alkyl benzene sulfonate). When a regular detergent is used to clean clothes or household items, about 0.03–0.13% of surface active agent will be left after washing, which is harmful to the skin. When residual LAS is adhered to the fibers of clothes, it tends to irritate the skin and to pass through the skin into the inside of the body, causing a liver failure, an increasing of cholesterol concentration in blood, or an occurrence of many other diseases. Furthermore, when waste water is carried to rivers, lakes, oceans, etc., the water will be polluted. Because ABS and LAS contain high unit heavy metal $P_2O_2$, phosphate, surface active agent, fluorescent substance, it must be kept away from the eyes. Conventional detergents commonly have a warning word on the packages, warning people not to eat, or to touch with the eyes. When the eyes are touched with a detergent, the eyes must be immediately washed with clean water for 15 minutes, and then go to a doctor for remedy. If one eats a detergent by an error, one must immediately drink a big volume of milk or water, and then go to a doctor for remedy.

SUMMARY OF THE INVENTION

The present invention has been accomplished under the circumstances in view. It is one object of the present invention to provide a multipurpose cleaning agent which is safe in use. It is another object of the present invention to provide a multipurpose cleaning agent which is less pollutive. It is still another object of the present invention to provide a multipurpose cleaning agent which achieves a high cleaning effect. It is still another object of the present invention to provide a multipurpose cleaning agent which is practical for cleaning the face, the hair, the body, fruits, vegetables, and any of a variety of household items. It is still another object of the present invention to provide a multipurpose cleaning agent which is inexpensive to manufacture. According to the present invention, a multipurpose cleaning agent is made from 0.5–8% sodium alkyl sulfate, 2.7–4% fatty acid coconut diethanolamide, 0.38–0.42% citric acid, 0.38–0.42% ethylene diamine tetraacetic acid, 0.42–0.48% sodium citrate, 2.88–3.2% water, 1.88–2.5% sodium polyoxyethylene alkyl ether sulfate, 0.5–1% sodium carboxy methyl cellulose, 0.2–0.4% sodium percarbonate, 2–5% sodium tripoly phosphate, 40.38–35.89% low density sodium carbonate, 40.38–35.89% $Na_2SO_4.H_2O$ 0.4–0.8%, savinase 40T, and 1–2% celluzyme 0.7T.

DETAILED DESCRIPTION OF THE PREFERRED EMBODIMENT

A multipurpose cleaning agent in accordance with the present invention contains:

| | |
|---|---|
| 6.5–8% | Sodium alkyl sulfate |
| 2.7–4% | Fatty acid coconut diethanolamide |
| 0.38–0.42% | Citric acid |
| 0.38–0.42% | Ethylene diamine tetraacetic acid |
| 0.42–0.48% | sodium citrate |
| 2.88–3.2% | Water |
| 1.88–2.5% | Sodium polyoxyethylene alkyl ether sulfate |
| 0.5–1% | CMC (Sodium carboxy methyl cellulose) |
| 0.2–0.4% | Sodium percarbonate ($2Na_2Co_33H_2O_2$) |
| 2–5% | Sodium tripoly phosphate |
| 40.38–35.89% | low density sodium carbonate |
| 40.38–35.89% | $Na_2SO_4.H_2O$ |
| 0.4–0.8% | Savinase 40T |
| 1–2% | Celluzyme 0.7T |

A cleaning agent manufacturing method in accordance with one embodiment of the present invention includes the steps of:

i) mixing 6.5–8% Sodium alkyl sulfate with 2.7–4% Fatty acid coconut diethanolamide for 2 minutes to form a mixture;

ii) mixing the mixture thus obtained with 0.38–0.42% Citric acid, 0.38–0.42%Ethylene diamine tetraacetic acid, 0.42–0.48% sodium citrate, and 2.88–3.2% Water at about 60°–70° C. for 2–4 minutes to form a solution;

iii) putting 1.88–2.5% Sodium polyoxyethylene alkyl ether sulfate in the solution thus obtained and mixing it for about 2–4 minutes, and then adding 0.5–1% CMC, 0.2–0.4% Sodium percarbonate and 2–5% Sodium tripoly phosphate to the solution and mixing it for about 5–8 minutes to form a gelatinous substance;

iv) mixing 40.38–35.89% low density sodium carbonate with 40.38–35.89% $Na_2SO_4.H_2O$ to form a mixture, and then mixing the mixture thus with the gelatinous substance obtained from step v) in a rotary mixture at a revolving speed about 80–120 r.p.m. for about 30 minutes to form a product A, which can be used for cleaning the face, the hair, the body, kitchen utensils, fruits and vegetables, etc.;

v) screening the product A thus obtained from step v) with a 20-mesh screen so as to obtain a product B; and vi) taking 10% of product B and mixing it with 0.4–0.8% Savinase 40T and 1–2% Celluzyme 0.7T for about 1–2 minutes, and putting the mixture in the remaining 90% of product B and mixing it for about 10–20 minutes to form a product C.

As indicated, the aforesaid product A can be used as a multipurpose detergent for cleaning clothes, the hair, the body, a variety of household items and kitchen utensils, fruits and vegetables, etc. The aforesaid product C can be used for cleaning clothes.

While only one embodiment of the present invention has been shown and described, it will be understood that various modifications and changes could be made without departing from the spirit and scope of the invention disclosed.

What the invention claimed is:

1. A multipurpose cleaning agent containing 6.5–8% sodium alkyl sulfate, 2.7–4% fatty acid coconut diethanolamide, 0.38–0.42% citric acid, 0.38–0.42% ethylene diamine tetraacetic acid, 0.42–0.48% sodium citrate, 2.88–3.2% water, 1.88–2.5% sodium polyoxyethylene alkyl ether sulfate, 0.5–1% CMC (Sodium carboxy methyl cellulose), 0.2–0.4% sodium percarbonate ($2Na_2Co_33H_2O_2$), 2–5% sodium tripoly phosphate, 40.38–35.89% low density sodium carbonate, 40.38–35.89% $Na_2SO_4.H_2O$, 0.4–0.8% savinase 40T, and 1–2% celluzyme 0.7T.

* * * * *